United States Patent [19]

Müller et al.

[11] Patent Number: 5,003,335

[45] Date of Patent: Mar. 26, 1991

[54] SHEET FILM DEVELOPING DEVICE

[75] Inventors: Jürgen Müller; Alfons Kastl; Hans Ketterer, all of Munich, Fed. Rep. of Germany

[73] Assignee: Agef-Gevaert AG, Leverkusen, Fed. Rep. of Germany

[21] Appl. No.: 379,807

[22] Filed: Jul. 13, 1989

[30] Foreign Application Priority Data

Jul. 29, 1988 [DE] Fed. Rep. of Germany ..... 3825777

[51] Int. Cl.[5] ..... G03D 3/08

[52] U.S. Cl. ..... 354/312; 354/298; 354/322; 271/9

[58] Field of Search ..... 354/298, 319, 320, 322, 354/312; 355/27, 100, 106; 271/9, 10, 100

[56] References Cited

U.S. PATENT DOCUMENTS

| | | | |
|---|---|---|---|
| 4,285,510 | 8/1981 | Kanno et al. | 271/9 |
| 4,299,380 | 11/1981 | Ogihara et al. | 271/9 |
| 4,324,480 | 4/1982 | Nomura et al. | 354/320 |
| 4,483,528 | 11/1984 | Takeyama et al. | 271/9 |
| 4,579,444 | 4/1986 | Pinckney et al. | 355/75 X |
| 4,723,151 | 2/1988 | Sonezaki et al. | 355/27 |

FOREIGN PATENT DOCUMENTS 7200515 3/1971 Fed. Rep. of Germany .

3444557 6/1985 Fed. Rep. of Germany .

*Primary Examiner*—A. A. Mathews

*Attorney, Agent, or Firm*—Michael J. Striker

[57] ABSTRACT

A sheet film developing device with a dark chamberside introduction of sheet films to be developed comprises a developing unit, a unit for moving a sheet film to the developing unit, a sheet film supplying unit for supplying sheet films to the developing unit, the sheet film supplying unit including a sheet film stacking device provided with a loading flap openable from outside for inserting a sheet film stack, a pulling device for pulling individual sheet films at a side of a stack opposite to the loading flap, an individual sheet supporting surface associated with the loading flap, a sheet film transporting unit arranged after the pulling device and the individual sheet supporting surface operative for guiding a sheet film from one of the individual sheet supporting surface and the sheet film stacking device in a transporting direction, and a sheet film sensing unit located in a transporting path defined by the sheet film transporting unit and operative for determining the presence of a sheet film on the individual sheet supporting surface and operative for turning off the pulling device and a part of the sheet film transporting unit located at a side of the stack and turning on the individual sheet supporting surface in response to the determining.

8 Claims, 4 Drawing Sheets

SHEET FILM DEVELOPING DEVICE

BACKGROUND OF THE INVENTION

The present invention relates to a sheet film developing device, and particularly with a dark chamber-side insertion of sheet film to be developed.

Devices of the above mentioned general type are known in the art. A known device includes a sheet film wet developing unit with a dark chamber-side insertion of the sheet film, and a transporting unit for moving the sheet films through the device. In the known devices the sheet films are supplied to the developing unit individually by hand. In general, also a sheet film stack is known with which the individual sheets are automatically withdrawn from a stack one after another and inserted in the device. When such a sheet film stack is used for supply to the developing unit, there will be no possibility to immediately develop individual sheet films.

SUMMARY OF THE INVENTION

Accordingly, it is an object of the present invention to provide a sheet film wet developing device which avoids the disadvantages of the prior art.

It is also an object of the invention to supply sheet films in a stack manually and to develop them automatically, and on the other hand to develop special fast sheet films as well.

In keeping with these objects and with others which will become apparent hereinafter, one feature of the present invention resides, briefly stated, in a sheet film developing device which comprises developing means, transporting means, and means for supplying sheet films to the developing means, wherein the device has a sheet film stacking means with an outwardly openable loading flap for insertion sheet film stacks, pulling means for individual sheet films at a side facing away of the loading flap, an individual sheet film supporting surface located above or below the loading flap, sheet film transporting means provided after the pulling means and individual sheet supporting surface and supply a sheet film from the individual sheet supporting surface or from the sheet film stack means in a transporting direction, sheet film sensing means located in a transporting path determined by the sheet film transporting means and operative for turning off a drive for the pulling means and for a stack-side part of the sheet film transporting means and for turning on the individual sheet supporting surface in response to detecting the presence of a sheet film on the individual sheet film supporting surface.

When the sheet film developing device is designed in accordance with these features, it attains the above specified objects.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
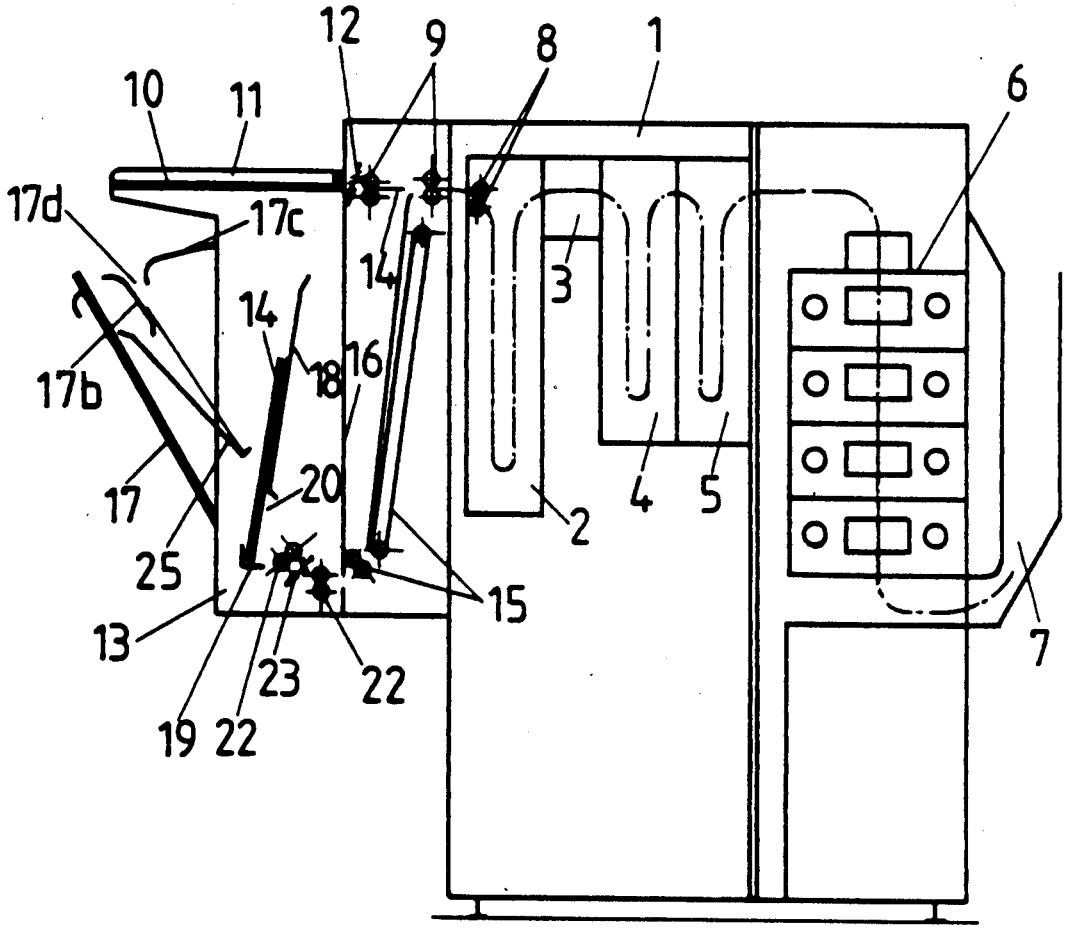
FIG. 1 is a schematic side view of one embodiment of the sheet film wet developing device in accordance with the present invention.

FIGS. 1–4 show a sheet film develop device 1 with treatments tanks, 2–5, a subsequently arranged drying device 6 with sheet film transporting means which are known and therefore not shown in the drawings, and a collecting device 7 for finished sheet films. An input transporting track 9 which can be formed of rollers or transporting bands is located before an input roller pair 8 of the developing device 1. Also, individual sheet placing surface 10 with a vertically turnable cover 11 is associated with the track 9. In the region of the input transporting track 9 for example immediately before it, a sensing device 12 is provided. The sensing device serves for detecting a sheet film inserted in the individual sheet placing surface 10. It can be formed for example as infrared light barrier. On the other hand, it can be formed of another type.

Figure 2:
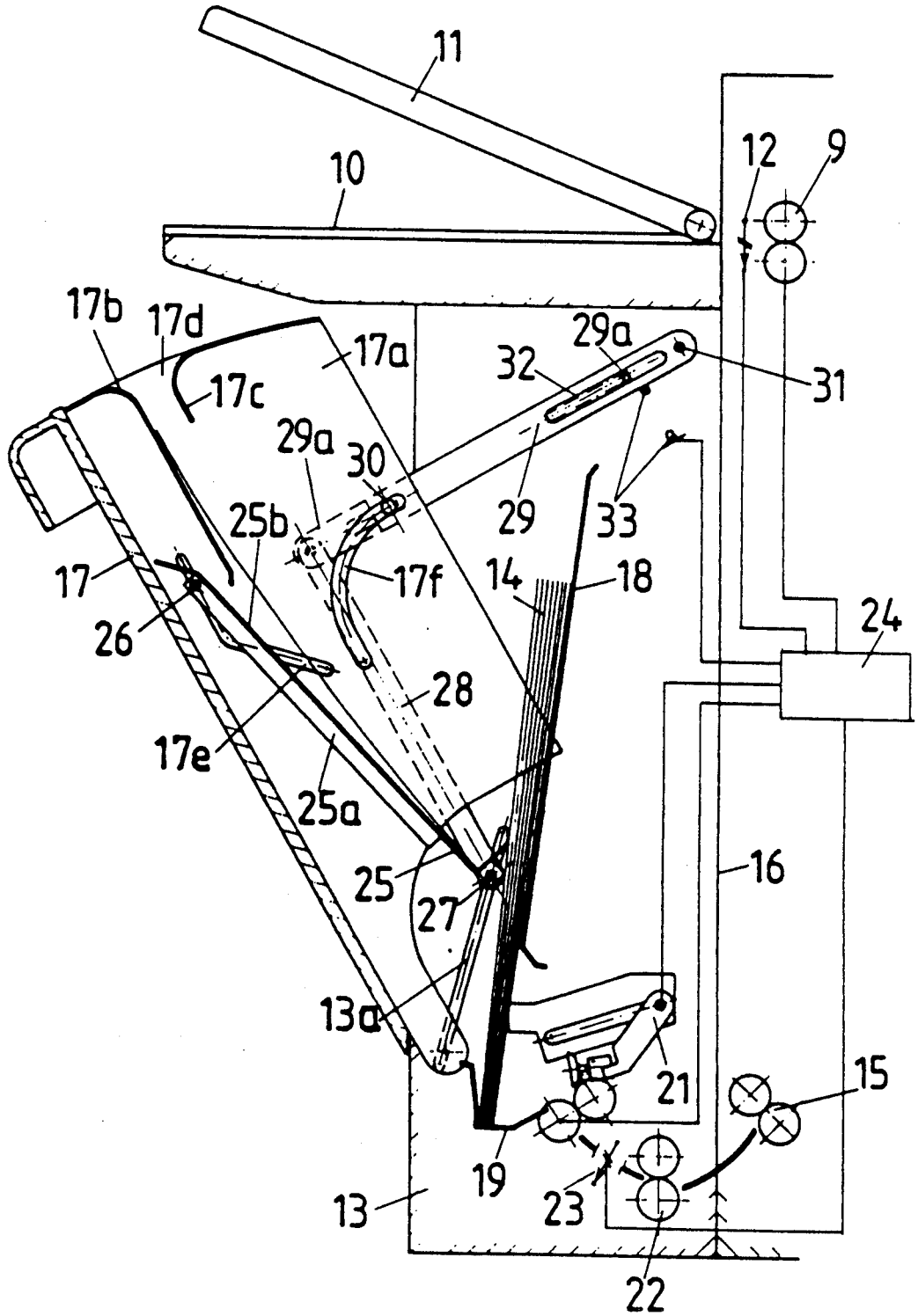
FIG. 2 is a view showing the inventive parts of the device of FIG. 1 in the position of introduction of sheet films.
Figure 3:
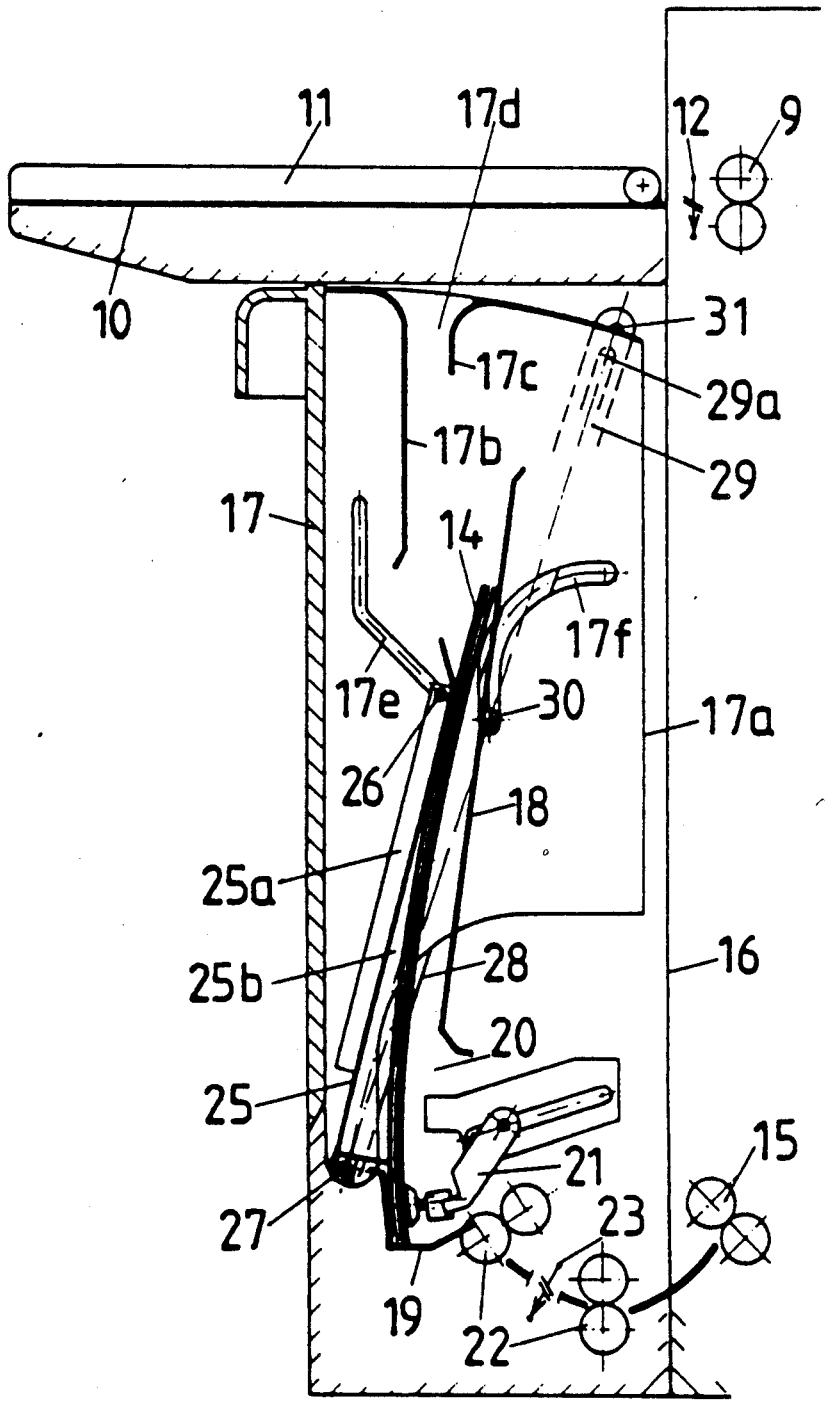
FIG. 3 is a view showing the inventive parts of FIG. 2 in their operational position.

FIGS. 1–3 show a housing part 13 located under the individual sheet placing surface 10 and provided with a sheet film stacking device. An individual sheet film 14 is supplied from the stacking device in an intermediate transporting track 15 and from there is guided into the input transporting track 9 and then into the developing device 1. Advantageously, an intermediate wall 16 with a throughgoing slot for the sheet film 14 is located between the stacking device and the intermediate transporting track 15. A loading flap 17 or a closeable cover is articulately connected with the housing part 13. In the open position of the loading flap 17 the sheet film stack or individual sheet films 14 can be introduced by hand into the stacking device.

An supporting surface 18 for a sheet film stack is fixedly arranged in the interior of the housing part 13 opposite to the loading flap 17. It is somewhat inclined from above downwardly relative to the vertical plane toward the loading flap 17. A collecting basket 19 is located under the supporting surface 18 at a distance from it. A gap 20 is formed between both parts 18 and 19. The pulling device 21 is located behind the gap 20 for the lowermost sheet film 14 supported on the supporting surface 18. A sheet film stack which lies on the supporting surface 18 lies with its lower end in the collecting basket 19. When the device 1 is in operation, the lowermost sheet film is pulled downwardly and rearwardly from the stack device by the pulling device 21 which is formed in one embodiment as a sacker and then introduced with its lower edge into the sheet film transporting means 22 which can be formed for example as a transporting roller pair. The sheet film transporting means 22 supply the sheet film further to the transporting track 15, and from the latter into the developing device 1 in the above described manner. In the region of the sheet film transporting path which is defined by the sheet film transporting means 22, at least one sheet film sensing means 23 is arranged. It is formed for example as an infrared light barrier and determines the presence of a sheet film in the transporting path in a control circuit 24. The sensing device 12 is connected with this control circuit 24.

A catching basket 25 is also arranged on the loading flap 17. It includes an L-shaped plate which is articulately connected with the loading flap 17 through a carrier bar 25*a* so that its carrier surface 25*b* for inserted sheet film is inclined in an opposite direction relative to the inclination of the supporting surface 18 when the loading flap 17 is opened. In the closed position of the loading flap 17, the carrier surface 25*b* is inclined to the supporting surface 18 so that a sheet film lying on the carrier surface 25*b* falls on the supporting surface 18 or on a sheet film stack lying on it. In this closed position the loading flap 17 lies over the lower end of the collecting basket 25 and before the fixed collecting basket 19 so that the lower edge of the sheet film located in the collecting basket 25 slides into the fixed collecting basket 19 and thereby the sheet films located in the collecting basket 25 are placed in the stack device 18, 19 so that after the transportation of the previously stacked sheet films they are also transported by the pulling device 21 one after the other into the device 1.

The loading flap 17 has side walls 17*a*. Guiding plates 17*b* and 17*c* mounted the side walls to form an insertion passage 17*d* for individual or several sheet films or sheet film stack parts to be inserted. It is formed so that in the open position of the loading flap 17 the inserted sheet films directly slide on the carrying carrier surface 25*b* and into the flap-side collecting basket 25. For controlling the movement both of the loading flap 17 and of the flap-side collecting basket 25, two slot curves 17*e* and 17*f* can be provided in at least one of the side walls 17*a*. Moreover, a further slot curve 13*a* shown in FIG. 2 can be arranged in the housing part-side wall. The control of the movement of the collecting basket 25 is performed by a pin 26 which is arranged on the carrier part 25*a* and engages in the slot curve 17*e*, and by a further pin 27 which is arranged on the carrier part 25*a* and engages in the slot curve 13*a*. The control of a turning-tilting movement of the loading flap 17 is performed by a linkage triangle having links 28 and 29. A pin 30 is arranged in the link 29 and engages in the slot curve 17*f*. The link 28 is provided at its lower end with the pin 27 so that the link 28 and the collecting basket 25 are together guided in the slot curve 13*a*. The free end of the link 29 is rotatably supported in the housing part 13 at the point 31. Depending upon the shape or length of the movement path of the loading flap 17, it can be needed that the link 29 is formed telescopically extendable. The extendable and retractable link part 29*a* can be coupled through a spring 32 with the link part 29 articulately connected at the point 31. It is to be understood that also another suitable control mechanics can be used for the loading flap 17 and the flap-side collecting basket 25.

Figure 4:
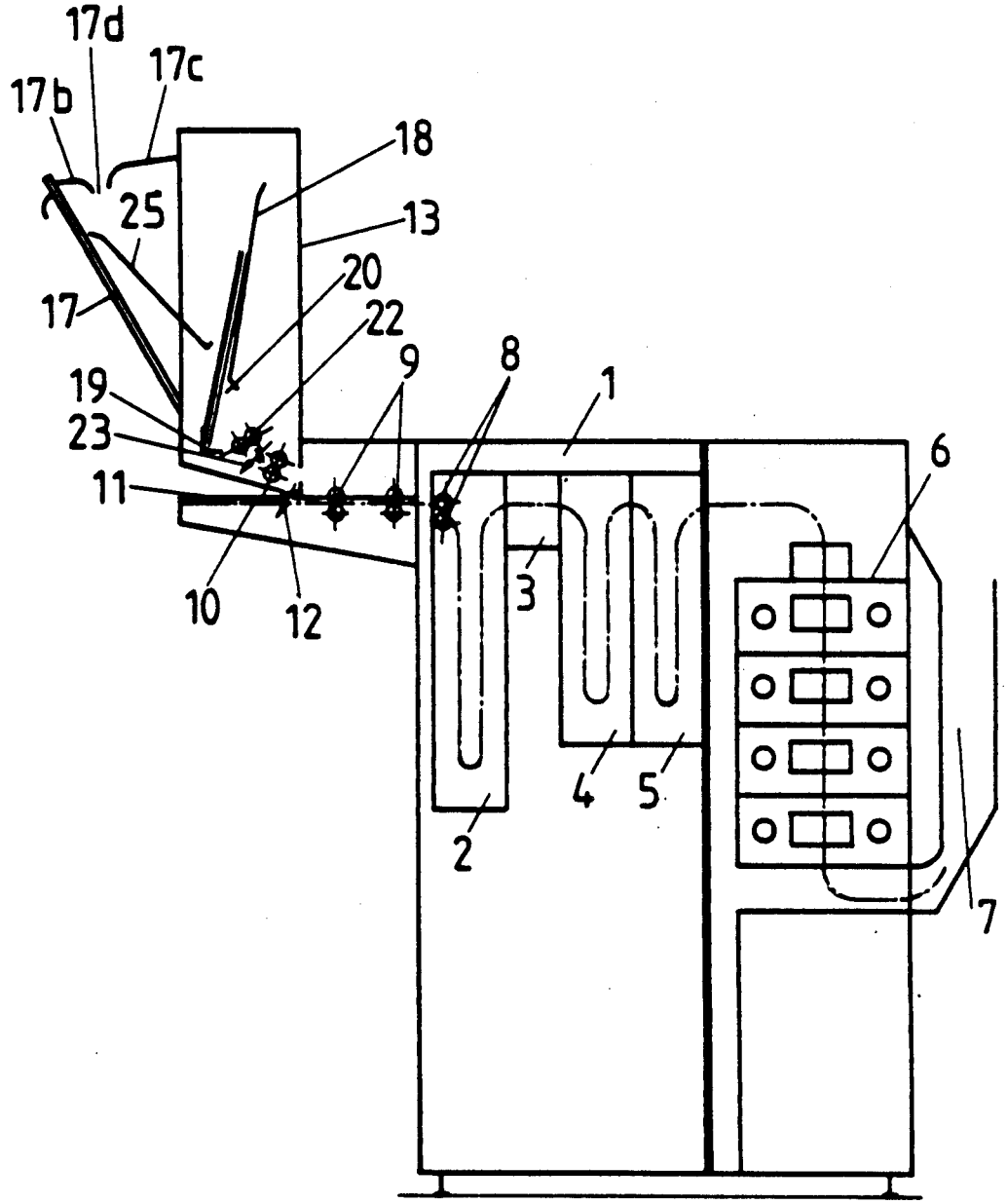
FIG. 4 is a schematic side view showing another embodiment of the sheet film developing device in accordance with the present invention.

In the embodiment shown in FIG. 4, the stacking device 18, 19 with the loading flap 17 is arranged above the individual sheet supporting surface 10. Thereby the sheet film transporting track 9, 22 is shorter. As a result, the whole device is more space economical. The parts in this embodiment which are identical with the parts of the first embodiment are identified with the same reference numerals. The operation of the device is substantially the same.

The operation of arrangement in accordance with the present invention is performed as follows:

For inserting sheet films or sheet film stack parts which are automatically pulled from the stack and must be introduced into the device 1, loading flap 17 is opened and the sheet films are inserted into the insertion passage 17*d*. From it, they fall in the flap-side collecting basket 25 and laid during closing of the loading flap 17 in the stack device 18, 19. Then the sheet films are pulled through the slot 20 downwardly one after the other and transported into the developing device 1. The light barrier 23 determines the presence of the sheet film in the path of the transporting means 22. When now a special fast sheet film is displaced onto the individual sheet supporting surface 10 to the light barrier 12, the latter indicated on the control device 24 that a transportation must be performed. By means of the control device, the pulling device 21 is stopped and no further sheet film can be pulled from the stack. After releasing the sheet film transporting tracks defined by the transporting means 22 and 15, the transporting track 9 is switched on and the individual sheet film inserted in it is supplied in the developing device 1. When this sheet film is introduced into the developing device 1 and no further individual films follow at the light barrier 12, the pulling device 21 is again set into operation by the control device 24 and the sheet film transport from the stack continues. It is essential that a main switch 33 can be provided. With this switch in the closed position of the loading flap 17, the drive for the pulling means 21 and the stack-side sheet transporting means 22 can be switched on.

It will be understood that each of the elements described above, or two or more together, may also find a useful application in other types of constructions differing from the types described above.

While the invention has been illustrated and described as embodied in a sheet film developing device with a dark chamber-side introduction of sheet films to be developed it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A sheet film developing device with a dark chamber-side introduction of sheet films to be developed, comprising developing means; means for moving a sheet film to said developing means; sheet film supplying means for supplying sheet films to said developing means, said sheet film supplying means including a sheet film stacking device provided with a loading flap openable from outside for inserting a sheet film stack, a pulling device for pulling individual sheet films at a side of a stack opposite to said loading flap, an individual sheet supporting surface associated with said loading flap, sheet film transporting means arranged after said pulling device and said individual sheet supporting surface operative for guiding a sheet film from one of said individual sheet supporting surface and said sheet film stacking device in a transporting direction, and a sheet film sensing means located in a transporting path defined by said sheet film transporting means and operative for determining the presence of a sheet film on said individual sheet supporting surface and operative for turning off a drive for said pulling device and a part of said sheet film transporting means located at a side of the stack and turning on a drive for said individual sheet supporting surface in response to said determining.

2. A sheet film developing device as defined in claim 1, wherein said individual sheet supporting surface is arranged under said loading flap.

3. A sheet film developing device as defined in claim 1, wherein said individual sheet supporting surface is is arranged above said loading flap.

4. A sheet film developing device as defined in claim 1; and further comprising a main switch which is closed in a closed position of said loading flap and in its open position prevents the turning on the drive/pulling device of said pulling device and said stack-side part of said sheet film transporting means.

5. A sheet film developing device as defined in claim 1, wherein said sheet film stacking device has a sheet film stack supporting surface, said loading flap being turnably supported relative to said sheet film stack supporting surface and provided with a first collecting basket for a sheet film stack, said supplying means having a further collecting basket located deeper and forming together with said sheet film stack supporting surface a gap behind which said pulling device is arranged, said gap being formed so that a sheet film lying opposite to a staple side facing away of said loading flap is guided through said gap, said sheet film stack supporting surface and said first collecting basket in a closed position of said loading flap being inclined relative to one another so that a sheet film stack part lying in said first collecting basket slides into said further collecting basket.

6. A sheet film developing device as defined in claim 5, wherein said loading flap has side walls provided with an insertion passage for a sheet film stack part, and said first collecting basket being guided to said insertion passage on said loading flap in a rotatable and displaceable manner.

7. A sheet film developing device as defined in claim 1, wherein said loading flap being guided on said developing means in a rotatable and displaceable manner.

8. A sheet film developing device as defined in claim 1, wherein said loading flap has side walls, at least one of said side walls is provided with two different slot curves; and further comprising a link triangle having one link provided with a pin engaging in one of said slot curves, said one link being turnably supported on said developing means telescopically extendable, said link triangle having another link provided with a further pin guided in a further slot, said first catching basket having one end provided with a third pin which is guided in another one of said two different slot curves and a second end which is guided by the other pin of said further slot curve.

* * * * *